United States Patent [19]

Otsuka et al.

[11] 4,414,950

[45] Nov. 15, 1983

[54] FAIL SAFE DEVICE FOR AIR/FUEL RATIO FEEDBACK CONTROL SYSTEM

[75] Inventors: Kazuo Otsuka, Higashikurume; Shin Narasaka, Yono; Shumpei Hasegawa, Niiza, all of Japan

[73] Assignee: Honda Giken Kogyo Kabushiki Kaisha, Tokyo, Japan

[21] Appl. No.: 307,445

[22] Filed: Oct. 1, 1981

[30] Foreign Application Priority Data

Oct. 6, 1980 [JP] Japan ..... 55-140046

[51] Int. Cl.[3] ..... F02B 33/00; F02M 7/00

[52] U.S. Cl. ..... 123/479; 123/440; 123/589; 123/585

[58] Field of Search ..... 123/440, 479, 589, 489, 123/585

[56] References Cited

U.S. PATENT DOCUMENTS 3,916,848 11/1975 Schmidt ..... 123/479

4,075,835 2/1978 Hattori ..... 123/440

FOREIGN PATENT DOCUMENTS 54-105619 8/1979 Japan ..... 123/479

*Primary Examiner*—Ronald B. Cox

*Attorney, Agent, or Firm*—Lyon & Lyon

[57] ABSTRACT

A fail safe device comprising means for detecting a failure in an air/fuel ratio feedback control system and generating a fault signal when such failure is detected, and means responsive to the fault signal to drive an actuator for driving an air/fuel ratio control valve and also responsive to a reference position signal supplied thereto during the above driving, which is generated when the actuator passes its reference position, to stop the actuator at the reference position. The actuator driving/stopping means may comprise means for repeatedly driving the actuator over a predetermined operating range inclusive of the reference position a plurality of times when it is not supplied with the reference position signal upon the actuator passing the reference position, and means for driving the actuator from its extreme operating position to a predetermined position and holding the same there when it is not supplied with the reference position signal even after a predetermined number of times of the above repeated driving of the actuator.

3 Claims, 3 Drawing Figures

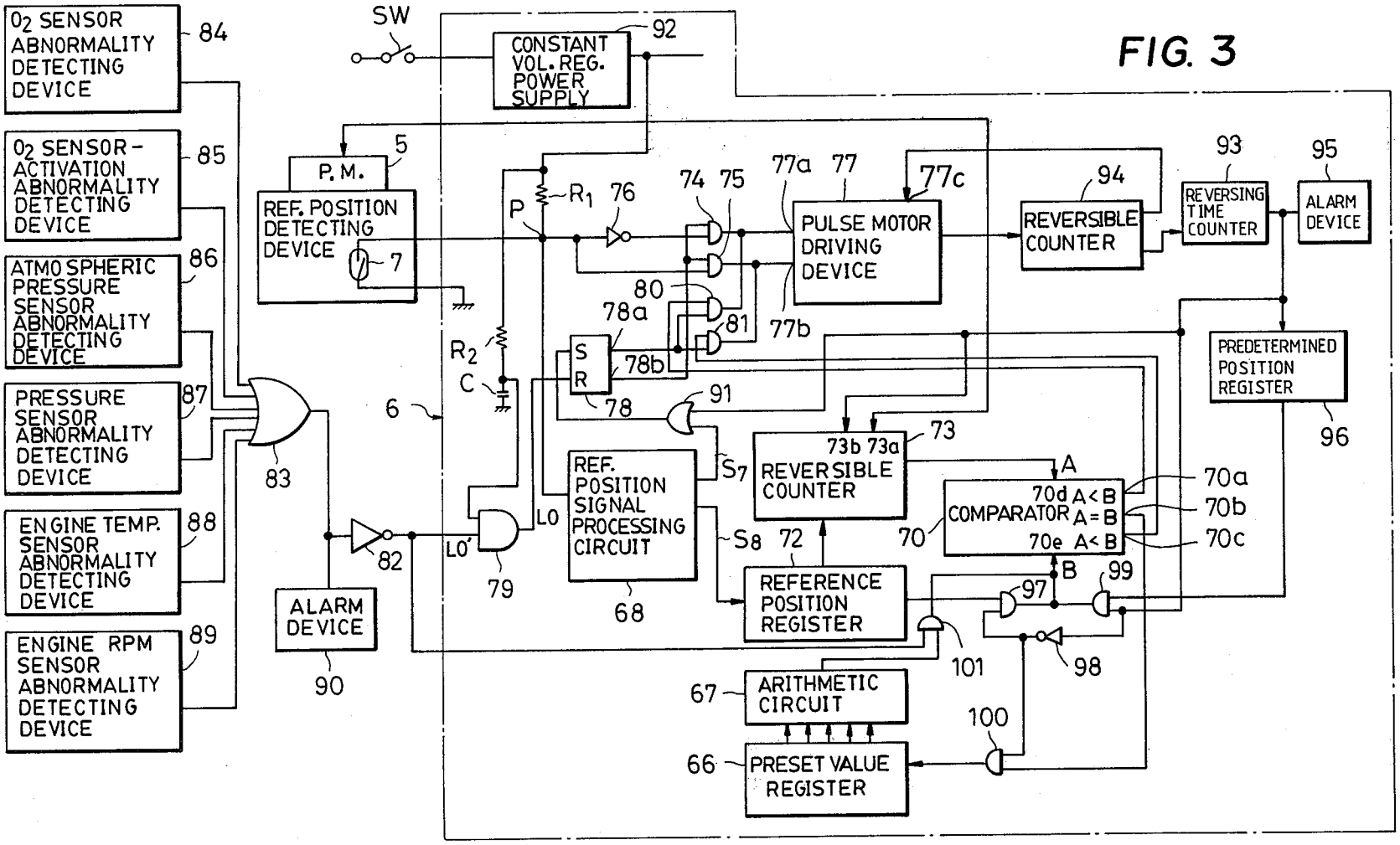
FIG. 3
ALARM DEVICE
95
REVERSING TIME COUNTER
93
PREDETERMINED POSITION REGISTER
96
REVERSIBLE COUNTER
94
70a
70b
70c
70d A<B
COMPARATOR A=B
70e A<B
70
99
98
97
100
101
77c
PULSE MOTOR DRIVING DEVICE
77
77a
77b
73
73b 73a
REVERSIBLE COUNTER
72
REFERENCE POSITION REGISTER
ARITHMETIC CIRCUIT
67
PRESET VALUE REGISTER
66
75
74
81
91
S7
S8
80
78a
78b
78
S
R
76
R1
P
92
CONSTANT VOL. REG. POWER SUPPLY
REF. POSITION SIGNAL PROCESSING CIRCUIT
68
LO
LO'
79
R2
C
6
SW
5
P.M.
REF. POSITION DETECTING DEVICE
7
82
ALARM DEVICE
90
83
84
O2 SENSOR ABNORMALITY DETECTING DEVICE
85
O2 SENSOR-ACTIVATION ABNORMALITY DETECTING DEVICE
86
ATMOSPHERIC PRESSURE SENSOR ABNORMALITY DETECTING DEVICE
87
PRESSURE SENSOR ABNORMALITY DETECTING DEVICE
88
ENGINE TEMP. SENSOR ABNORMALITY DETECTING DEVICE
89
ENGINE RPM SENSOR ABNORMALITY DETECTING DEVICE

FAIL SAFE DEVICE FOR AIR/FUEL RATIO FEEDBACK CONTROL SYSTEM

BACKGROUND OF THE INVENTION

This invention relates to an air/fuel ratio feedback control system for internal combustion engines, and more particularly to fail safe device for detecting a failure in such system and performing necessary fail safe actions.

An air/fuel ratio feedback control system for performing feedback control of the air/fuel ratio of an air/fuel mixture being supplied to an internal combustion engine has already been proposed by the applicants of the present application, which comprises a sensor for detecting the concentration of an exhaust gas ingredient emitted from the engine, an air/fuel ratio control valve of which the valve body position determines the air/fuel ratio of the mixture being supplied to the engine, an actuator arranged to displace the actuator in a continuous manner in response to an output signal generated by the sensor, and reference position detecting means for generating a reference position signal when the actuator passes a reference position which is provided between two opposite operating positions mechanically limiting the movable range of the actuator.

In principle, the above air/fuel ratio feedback control system proposed by the applicants is adapted to perform a feedback control operation in such a manner that the concentration of the exhaust gas ingredient is detected by means of the above sensor which may be comprised of an $O_2$ sensor provided in the exhaust pipe of the engine, and an electronic control circuit (e.g., ECU) operates on the output signal of the sensor to drive the actuator which may be comprised of a pulse motor for control of the air/fuel ratio control valve so as to achieve a proper air/fuel ratio of the mixture being supplied to the engine.

In addition to the above $O_2$ sensor, the air/fuel ratio feedback control system is provided with sensors for detecting the operating condition of the engine, which include an engine rpm sensor, an atmospheric pressure sensor, an intake pipe-absolute pressure sensor and an engine coolant temperature sensor. Responsive to output signals of these sensors, the electronic control circuit proceeds with a predetermined program to determine the fulfillment of a closed loop control condition and open loop control conditions and produce a control signal corresponding to a fulfilled control condition for driving the actuator. As for the $O_2$ sensor, the electronic control circuit has a circuit for detecting the activation of the $O_2$ sensor at the start of the engine, whereby determination is made as to the fulfillment of a condition of initiation of the air/fuel ratio control on the basis of an activation signal generated by the above detecting circuit and an output signal indicative of a value exceeding a predetermined value generated by the engine coolant temperature sensor.

The actuator or pulse motor is provided with a reference position detecting device which is comprised e.g. of a reed switch which is adapted to supply a reference position signal to the electronic control circuit when the actuator passes a predetermined reference position. The electronic control circuit is in turn responsive to this reference position signal to replace an actual actuator position value stored therein by a reference position value, this always accurately memorizing the actual position of the actuator for achievement of accurate air/fuel ratio control.

However, in the event of occurrence of abnormality in the output signals of these sensors due to a failure in the sensors or the reference position detecting device or a failure in the related wiring system, the electronic control circuit is unable to properly determine the fulfillment of the open loop control conditions and the closed loop control condition in response to the actual operating condition of the engine so that the resulting air/fuel ratio has an abnormal value, which can spoil the driveability and exhaust gas emission characteristics of the engine or cause a misfire in the engine.

The air/fuel ratio feedback control system can malfunction not only due to failure in the sensors or the reference position detecting device but also due to many other factors. If no emergency measure is taken in the event of occurrence of a failure in the air/fuel ratio feedback control system, sometimes one would not imagine what position the actuator will be controlled to. Let it now be assumed that in the event of occurrence of a failure in the system when the associated automotive vehicle is running in a location at high elevation, the actuator is stopped at a position RICH MAX corresponding to a minimum of air/fuel ratio, the resulting mixture is extremely rich, which greatly deteriorates the driveability of the engine and sometimes makes it impossible to drive the engine.

To avoid the above disadvantages, the air/fuel ratio feedback control system is provided with a fail safe function such that upon occurrence of a failure in the aforementioned sensors, the actuator is automatically moved to a particular position, namely, a predetermined idle position which is compensated for atmospheric pressure, and held there.

However, there can be a disagreement between the actual position of the pulse motor and a count in an actual pulse motor position counter provided in the electronic control circuit due to skipping or racing of the pulse motor or other factors. If a failure occurs in the system when the above disagreement exists, the pulse motor is not moved to and held at the aforementioned predetermined idle position with accuracy.

OBJECTS AND SUMMARY OF THE INVENTION

It is an object of the invention to provide a fail safe device which is operable upon occurrence of a failure in the air/fuel ratio feedback control system, in a manner such that the actuator is moved to and held at a reference position which is set substantially at the middle position between two extreme operating positions of the actuator and which does not correspond to an extreme value of the air/fuel ratio, to thereby keep the air/fuel ratio at a moderate value for avoidance of extreme deterioration of the driveability and exhaust gas emission characteristics of the engine or a misfire in the engine.

It is a further object of the invention to provide a fail safe device which is capable of achieving an appropriate air/fuel ratio corresponding to the reference position irrespective of a difference between the actual position of the actuator and the count in the actual actuator position counter within the electronic control circuit, when a failure occurs in the air/fuel ratio feedback control system, to thereby avoid deterioration of the driveability.

It is another object of the invention to provide a fail safe device which is adapted to repeatedly drive the actuator over a predetermined operating range in one direction and a direction reverse thereto alternately a plurality of times over and then drive the actuator from a second reference position which is mechanically limited, namely an extreme operating position of the actuator to a predetermined position and hold the same there, in the event of occurrence of a failure in the actuator reference position detecting device. The fail safe device is thus capable of detecting the failure in the actuator reference position detecting device and also accurately setting the actuator at the above predetermined position.

According to the invention, there is provided a fail safe device for use in an air/fuel ratio feedback control system for performing feedback control of the air/fuel ratio of an air/fuel mixture being supplied to an internal combustion engine. The air/fuel ratio feedback control system comprises a sensor for detecting the concentration of an exhaust gas ingredient emitted from an internal combustion engine, an air/fuel ratio control valve heating a valve position thereof disposed to determine the air/fuel ratio of the air/fuel mixture being supplied to the engine, an actuator arranged to displace the air/fuel ratio control valve in a continuous manner in response to an output signal generated by the sensor, and reference position detecting means for generating a reference position signal when the actuator passes a predetermined reference position which is provided between two opposite operating positions which mechanically limit the movable range of the actuator. The fail safe device comprises means for detecting a failure in the air/fuel ratio feedback control system and generating a fault signal when such failure is detected, and means responsive to the fault signal to drive the actuator and also responsive to the reference position signal which is supplied thereto while it is driving the actuator, to stop the actuator at the predetermined reference position. The above actuator driving/stopping means comprise means for repeatedly driving the actuator over a predetermined operating range inclusive of the predetermined reference position in one direction and in a direction reverse thereto alternately a plurality of times when it is not supplied with the reference position signal upon the actuator passing the predetermined reference position, and means for driving the actuator from a second predetermined reference position which is one of the two extreme operating positions to a predetermined position and holding the same there when it is not supplied with the reference position signal even after a predetermined number of times of the above repeated driving of the actuator.

The above and other objects, features and advantages of the invention will be more apparent from the ensuing detailed description taken in connection with the accompanying drawings in which:

BRIEF DESCRIPTION OF THE DRAWINGS

FIG. 3 is a circuit diagram illustrating a pulse motor driving circuit provided within ECU and incorporating the fail safe device according to the invention.

DETAILED DESCRIPTION

The invention will now be described in detail with reference to the drawings.

Figure 1:
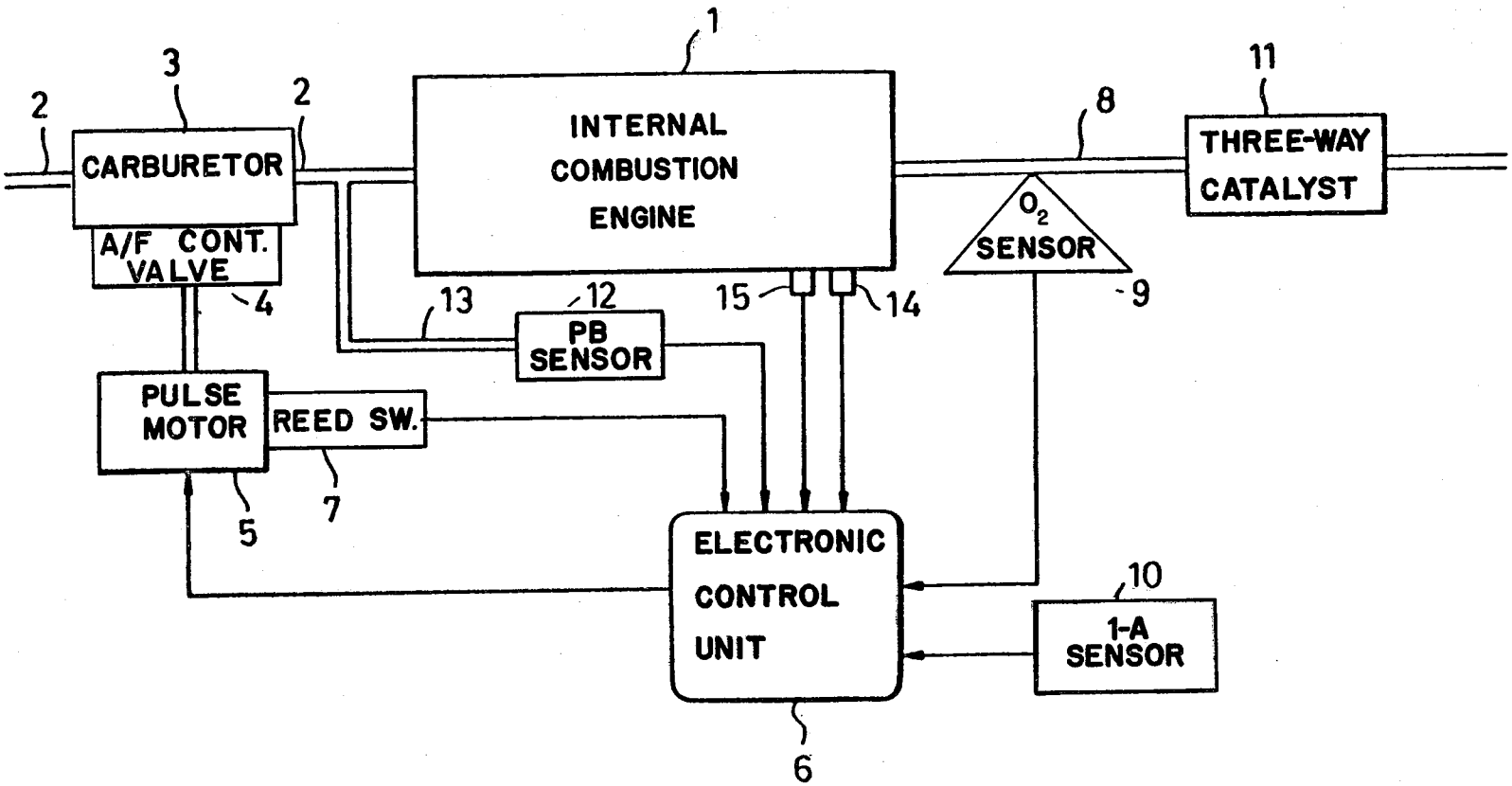
FIG. 1 is a block diagram illustrating the whole arrangement of an air/fuel ratio feedback control system to which the fail safe device according to the invention is applicable.

Referring first to FIG. 1, there is shown a block diagram illustrating the whole arrangement of an air/fuel ratio control system to which the fail safe device according to the invention is applicable.

Reference numeral 1 designates an internal combustion engine. Connected to the engine 1 is an intake manifold 2 which is provided with a carburetor generally designated by the numeral 3. The carburetor 3 has main and slow speed fuel passages, not shown, which communicate the float chamber, not shown, of the carburetor 3 with primary and secondary bores, not shown. These fuel passages communicate with the atmosphere by means of air bleed passages, not shown.

At least one of these fuel passages or air bleed passages is connected to an air/fuel ratio control valve 4. The air/fuel ratio control valve 4 is comprised of a required number of flow rate control valves, not shown, each of which has its valve body urged by a spring in a particular direction and arranged to be driven in the reverse direction by a push plate which is disposed for to-and-fro movement by means of a pulse motor 5 so as to vary the opening of the at least one of the above passages. The pulse motor 5 has its two opposite extreme operating positions limited by the above push plate and a stopper located opposite to the push plate. The pulse motor 5 is electrically connected to an electronic control unit (hereinafter called "ECU") 6 to be rotated by driving pulses supplied therefrom so that the flow rate control valves are displaced to vary the flow rate of air or fuel being supplied to the engine 1 through the at least one passage. Although the air/fuel ratio can be controlled by thus varying the flow rate of air or fuel being supplied to the engine 1, a preferable concrete measure should be such as varies the opening of at least one of the aforementioned air bleed passages to control the flow rate of bleed air.

The pulse motor 5 is provided with a reed switch 7 which is arranged to turn on or off depending upon the moving direction of the valve body of the air/fuel ratio control valve 4 each time the same valve body passes a reference position, to supply a corresponding binary signal to ECU 6.

On the other hand, an $O_2$ sensor 9, which is formed of stabilized zirconium oxide or the like, is mounted in the peripheral wall of an exhaust manifold 8 leading from the engine 1 in a manner projected into the manifold 8. The sensor 9 is electrically connected to ECU 6 to supply its output signal thereto. An atmospheric pressure sensor 10 is arranged to detect the ambient atmospheric pressure surrounding the vehicle, not shown, in which the engine 1 is installed, the sensor 10 being electrically connected to ECU 6 to supply its output signal thereto, too.

A pressure sensor 12 is provided in communication with the intake manifold 2 through a conduit 13 to detect absolute pressure in the manifold 2, the sensor being electrically connected to ECU 6 to supply its output signal thereto. Further, an engine temperature sensor (thermistor) 14 is inserted in the peripheral wall of an engine cylinder, the interior of which is filled with engine cooling water, to detect the temperature of the engine cooling water, the sensor being electrically connected to ECU 6, too, to supply its output signal thereto.

Incidentally, in FIG. 1, reference numeral 11 designates a three-way catalyst, and reference numeral 15 generally designates an engine rpm sensor which is comprised of a distributor and an ignition coil and arranged to supply pulses generated in the ignition coil to ECU 6.

Details of the air/fuel ratio control which can be performed by the air/fuel ratio control system outlined above will now be described by further reference to FIG. 1 which has been referred to hereinabove.

Initialization

Referring first to the initialization, when the ignition switch in FIG. 3 is set on, ECU 6 is initialized to detect the reference position of the actuator or pulse motor 5 by means of the reed switch 7 and hence drive the pulse motor 5 to set it to its best position (a preset position) for starting the engine, that is, set the initial air/fuel ratio to a predetermined proper value. The above preset position of the pulse motor 5 is hereinafter called "$PS_{CR}$". This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idle rpm.

The above reference position of the pulse motor 5 is detected as the position at which the reed switch 7 turns on or off, as previously mentioned with reference to FIG. 1.

Then, ECU 6 monitors the condition of activation of the $O_2$ sensor 9 and the coolant temperature Tw detected by the thermistor 14 to determine whether or not the engine is in a condition for initiation of the air/fuel ratio control. For accurate air/fuel ratio feedback control, it is a requisite that the $O_2$ sensor 9 is fully activated and the engine is in a warmed-up condition. The $O_2$ sensor, which is made of stabilized zirconium dioxide or the like, has a characteristic that its internal resistance decreases as its temperature increases. If the $O_2$ sensor is supplied with electric current through a resistence having a suitable resistance value from a constant-voltage regulated power supply provided within ECU 6, the electrical terminal potential or output voltage of the sensor initially shows a value close to the power supply voltage (e.g., 5 volts) when the sensor is not activated, and then, its electrical terminal potential lowers with the increase of its temperature. Therefore, according to the invention, the air/fuel ratio feedback control is not initiated until after the conditions have been fulfilled that the sensor produces an activation signal when its output voltage lowers down to a predetermined voltage Vx (e.g., 0.5 volt), a timer in ECU finishes counting for a predetermined period of time $t_x$ (e.g., 1 minute) starting from the occurrence of the above activation signal, and the coolant temperature Tw increases up to a predetermined value Twx at which an automatic choke, not shown, is opened to a degree to enabling the air/fuel ratio feedback control to function.

During the above stage of the detection of activation of the $O_2$ sensor and the coolant temperature Tw, the pulse motor 5 is held at its predetermined position $PS_{CR}$. The pulse motor 5 is driven to appropriate positions in response to the operating condition of the engine after initiation of the air/fuel ratio control, as hereinlater described.

Basic Air/Fuel Ratio Control

Following the initialization, the program in ECU 6 proceeds to the basic air/fuel ratio control.

ECU 6 is responsive to various detected value signals representing the output voltage V of the $O_2$ sensor 9, the absolute pressure $P_B$ in the intake manifold 2 detected by the pressure sensor 12, the engine rpm Ne detected by the rpm sensor 15, and the atmospheric pressure $P_A$ detected by the atmospheric pressure sensor 10, to drive the pulse motor 5 as a function of the values of these signals to control the air/fuel ratio. More specifically, the basic air/fuel ratio control comprises open loop control which is carried out at wide-open-throttle, at engine idle, at engine deceleration, and at engine acceleration at the standing start of the engine, and closed loop control which is carried out at engine partial load. All the control is initiated after completion of the warming-up of the engine.

First, the condition of open loop control at wide-open-throttle is met when the differential pressure $P_A - P_B$ (gauge pressure) between the absolute pressure $P_B$ detected by the pressure sensor 12 and the atmospheric pressure $P_A$ (absolute pressure) detected by the atmospheric pressure sensor 10 is lower than a predetermined value $\Delta P_{WOT}$. ECU 6 compares the difference in value between the output signals of the sensors 10, 12 with the predetermined value $\Delta P_{WOT}$ stored therein, and when the relationship of $P_A - P_B < \Delta P_{WOT}$ stands, drives the pulse motor 5 to a predetermined position (preset position) $PS_{WOT}$ and holds it there.

The condition of open loop control at engine idle is met when the engine rpm Ne is lower than a predetermined idle rpm $N_{IDL}$ (e.g., 1,000 rpm). ECU 6 compares the output signal value Ne of the rpm sensor 15 with the predetermined rpm $N_{IDL}$ stored therein, and when the relationship of $Ne < N_{IDL}$ stands, drives the pulse motor 5 to a predetermined idle position (preset position) $PS_{IDL}$ and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold 2 is lower than a predetermined value $PB_{DEC}$. ECU 6 compares the output signal value $P_B$ of the pressure sensor 12 with the predetermined value $PB_{DEC}$ stored therein, and when the relationship of $P_B < PB_{DEC}$ stands, drives the pulse motor 5 to a predetermined deceleration position (preset condition) $PS_{DEC}$ and holds it there.

The air/fuel ratio control at engine acceleration (i.e., standing start or off-idle acceleration) is carried out when the engine rpm Ne exceeds the aforementioned predetermined idle rpm $N_{IDL}$ (e.g, 1,000 rpm) during the course of the engine speed increasing from a low rpm range to a high rpm range, that is, when the engine speed changes from a relationship $Ne < N_{IDL}$ to one $Ne \geqq N_{IDL}$. On this occasion, ECU 6 rapidly moves the pulse motor 5 to a predetermined acceleration position (preset position) $PS_{ACC}$, which is immediately followed by initiation of the air/fuel ratio feedback control, described hereinlater.

During operations of the above-mentioned open loop control at wide-open-throttle, at engine idle, at engine deceleration, and at engine off-idle acceleration, the respective predetermined positions $PS_{WOT}$, $PS_{IDL}$, $PS_{DEC}$ and $PS_{ACC}$ for the pulse motor 5 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 6 performs selectively feedback control based upon proportional term correction (hereinafter called "P term control") and feedback control based upon integral term correction (hereinafter called "I term control"), in response to the engine rpm Ne detected by the engine rpm sensor 15 and the output signal V of the $O_2$ sensor 9. To be concrete, when the output voltage V of the $O_2$ sensor 9 varies only at the higher level side or only at the lower level side with respect to a reference voltage Vref, the position of the pulse motor 5 is corrected by an integral value obtained by integrating the value of a binary signal which changes in dependence on whether the output voltage of the $O_2$ sensor is at the higher level or at the lower level with respect to the predetermined reference voltage Vref (I term control). On the other hand, when the output signal V of the $O_2$ sensor changes from the higher level to the lower level or vice versa, the position of the pulse motor 5 is corrected by a value directly proportional to a change in the output voltage V of the $O_2$ sensor (P term control).

According to the above I term control, the number of steps by which the pulse motor is to be displaced per second is increased with an increase in the engine rpm so that it is larger in a higher engine rpm range.

Whilst, according to the P term control, the number of steps by which the pulse motor is to be displaced per second is set at a single predetermined value (e.g., 6 steps), irrespective of the engine rpm.

In transition from the above-mentioned various open loop control to the closed loop control at engine partial load or vice versa, changeover between open loop mode and closed loop mode is effected in the following manner: First, in changing from closed loop mode to open loop mode, ECU 6 moves the pulse motor 5 to a predetermined position $PS_{CR}$, $PS_{WOT}$, $PS_{IDL}$, $PS_{DEC}$ or $PS_{ACC}$, irrespective of the position at which the pulse motor was located immediately before entering each open loop control. This predetermined position is corrected in response to actual atmospheric pressure as hereinlater referred to.

On the other hand, in changing from open loop mode to closed loop mode, ECU 6 commands the pulse motor 5 to initiate air/fuel ratio feedback control with I term correction.

To obtain optimum exhaust emission characteristics irrespective of changes in the actual atmospheric pressure during open loop air/fuel ratio control or at the time of shifting from open loop mode to closed loop mode, the position of the pulse motor 5 needs to be compensated for atmospheric pressure. According to the invention, the above-mentioned predetermined or preset positions $PS_{CR}$, $PS_{WOT}$, $PS_{IDL}$, $PS_{DEC}$ and $PS_{ACC}$ at which the pulse motor 5 is to be held during the respective open loop control operations are corrected in a linear manner as a function of changes in the atmospheric pressure $P_A$, using the following equation:

$$PSi(P_A)=PSi+(760-P_A)\times Ci$$

where i represents any one of CR, WOT, IDL, DEC, and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 6.

ECU 6 applies to the above equation the coefficients PSi, Ci which are determined at proper different values according to the kinds of open loop control to be carried out, to calculate by the above equation the position $PSi(P_A)$ for the pulse motor 5 to be set at a required kind of open loop control and moves the pulse motor 5 to the calculated position $PSi(P_A)$.

Figure 2:
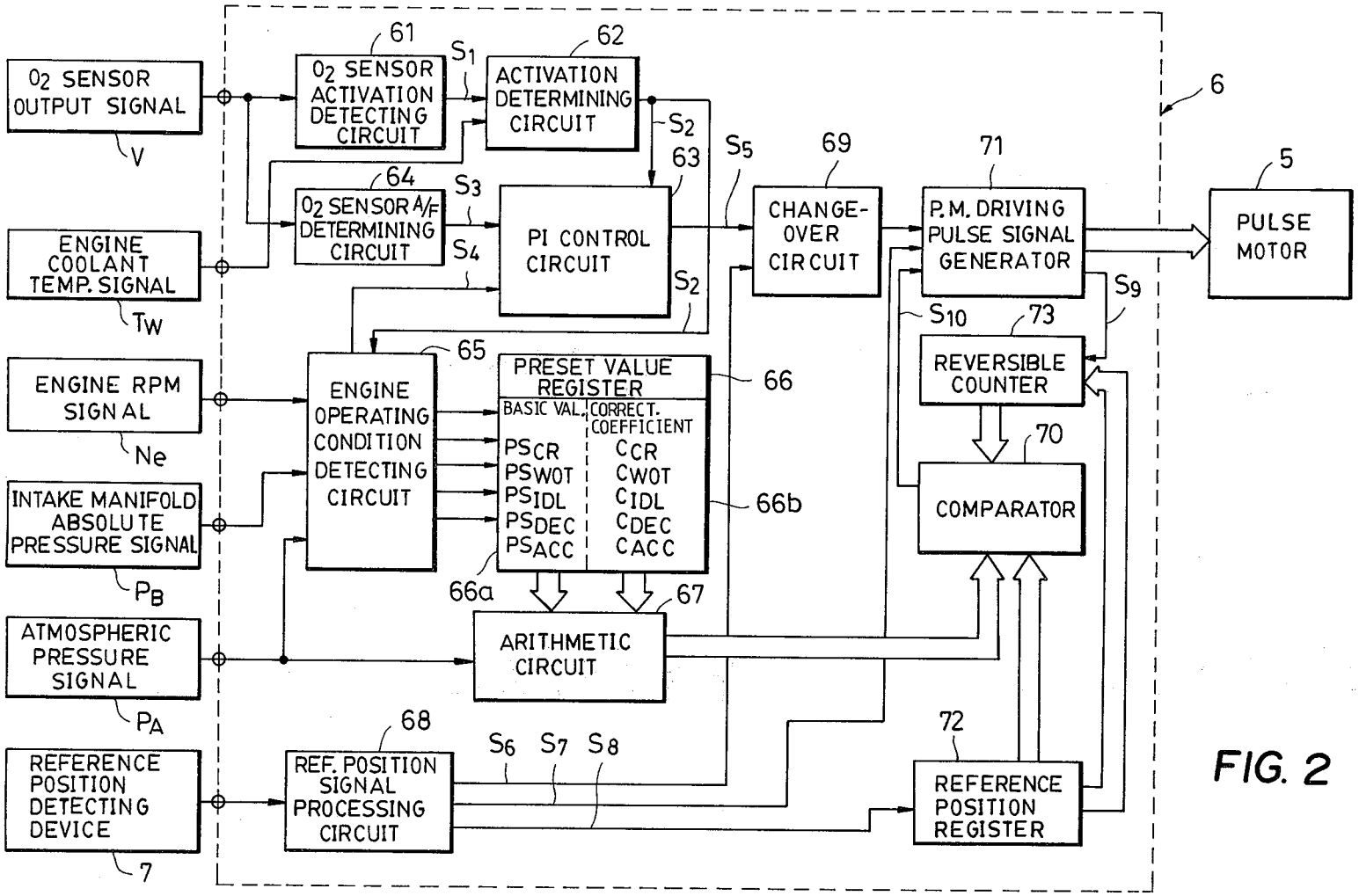
FIG. 2 is a block diagram illustrating an electrical circuit provided within the electronic control unit (ECU) appearing in FIG. 1.

FIG. 2 is a block diagram illustrating the interior construction of ECU 6 used in the air/fuel ratio control system having the above-mentioned functions according to the invention. In ECU 6, reference numeral 61 designates a circuit for detecting the activation of the $O_2$ sensor 9 in FIG. 1, which is supplied at its input with an output signal V from the $O_2$ sensor. Upon passage of the predetermined period of time $t_x$ after the voltage of the above output signal V has dropped below the predetermined value Vx, the above circuit 61 supplies an activation signal $S_1$ to an activation determining circuit 62. This activation determining circuit 62 is also supplied at its input with an engine coolant temperature signal Tw from the thermistor 14 in FIG. 1. When supplied with both the above activation signal $S_1$ and the coolant temperature signal Tw indicative of a value exceeding the predetermined value Twx, the activation determining circuit 62 supplies an air/fuel ratio control initiation signal $S_2$ to a PI control circuit 63 to render the same ready to operate. Reference numeral 64 represents an air/fuel ratio determining circuit which determines the value of air/fuel ratio of engine exhaust gases, depending upon whether or not the output voltage of the $O_2$ sensor 9 is larger than the predetermined value Vref, to supply a binary signal $S_3$ indicative of the value of air/fuel ratio thus obtained, to the PI control circuit 63. On the other hand, an engine operating condition detecting circuit 65 is provided in ECU 6, which is supplied with an engine rpm signal Ne from the engine rpm sensor 15, an absolute pressure signal $P_B$ from the pressure sensor 12, at atmospheric pressure signal $P_A$ from the atmospheric pressure sensor 10, all the sensors being shown in FIG. 1, and the above control initiation signal $S_2$ from the activation determining circuit 62 in FIG. 2, respectively. The circuit 65 supplies a control signal $S_4$ indicative of a value corresponding to the values of the above input signals to the PI control circuit 63. The PI control circuit 63 accordingly supplies a change-over circuit 69 to be referred to later with a pulse motor control signal $S_5$ having a value corresponding to the air/fuel ratio signal $S_3$ from the air/fuel ratio determining circuit 64 and a signal component corresponding to the engine rpm Ne in the control signal $S_4$ supplied from the engine operating condition detecting circuit 65. The engine operating condition detecting circuit 65 also supplies the PI control circuit 63 with the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine operating condition detecting circuit 65, the PI control circuit 63 interrupts its own operation. Upon interruption of the supply of the above signal component to the control circuit 63, a pulse signal $S_5$ is outputted from the circuit 63 to the change-over circuit 69, which signal starts air/fuel ratio control with integral term correction.

A preset value register 66 is provided in ECU 6, which is formed of a basic value register section 66*a* in which are stored the basic values of preset values $PS_{CR}$, $PS_{WOT}$, $PS_{IDL}$, $PS_{DEC}$ and $PS_{ACC}$ for the pulse motor position, applicable to various engine conditions, and a correcting coefficient register section 66*b* in which are stored atmospheric pressure correcting coefficients $C_{CR}$, $C_{WOT}$, $C_{IDL}$, $C_{DEC}$ and $C_{ACC}$ for these basic values. The engine operating condition detecting circuit 65 detects the operating condition of the engine based upon the activation of the $O_2$ sensor and the values of engine rpm Ne, intake manifold absolute pressure $P_B$ and atmospheric pressure $P_A$ to read from the register 66 the basic value of a preset value corresponding to the detected operating condition of the engine and its corresponding correcting coefficient and apply the same to an arithmetic circuit 67. The arithmetic circuit 67 performs arithmetic operation responsive to the value of the atmospheric pressure signal $P_A$, using the equation $PSi(P_A)=PSi+(760-P_A)\times Ci$. The resulting preset value is applied to a comparator 70.

A reference position signal processing circuit 68 is provided in ECU 6, which is responsive to the output signal of the reference position detecting device (reed switch) 7, indicative of the switching of the same, to generate a binary signal $S_6$ having a certain level from the start of the engine until it is detected that the pulse motor reaches the reference position. This binary signal $S_6$ is supplied to the change-over circuit 69 which in turn keeps the control signal $S_5$ from being transmitted from the PI control circuit 63 to a pulse motor driving signal generator 71 as long as it is supplied with this binary signal $S_6$, thus avoiding the interference of the operation of setting the pulse motor to the initial position with the operation of P-term/I-term control. The reference position signal processing circuit 68 also generates a pulse signal $S_7$ in response to the output signal of the reference position detecting device 7, which signal causes the pulse motor 5 to be driven in the step-increasing direction or in the step-decreasing direction so as to detect the reference position of the pulse motor 5. This signal $S_7$ is supplied directly to the pulse motor driving signal generator 71 to cause the same to drive the pulse motor 5 until the reference position is detected. The reference position signal processing circuit 68 generates another pulse signal $S_8$ each time the reference position is detected. This pulse signal $S_8$ is supplied to a reference position register 72 in which the value of the reference position (e.g., 50 steps) is stored. This register 72 is responsive to the above signal $S_8$ to apply its stored value to one input terminal of the comparator 70 and to the input of a reversible counter 73. The reversible counter 73 is also supplied with an output pulse signal $S_9$ generated by the pulse motor driving signal generator 71 to count the pulses of the signal $S_9$ corresponding to the actual position of the pulse motor 5. When supplied with the stored value from the reference position register 72, the counter 73 has its counted value replaced by the value of the reference position of the pulse motor.

The counted value thus renewed is applied to the other input terminal of the comparator 70. Since the comparator 70 has its other input terminal supplied with the same pulse motor reference position value, as noted above, no output signal is supplied from the comparator 70 to the pulse motor driving signal generator 71 to thereby hold the pulse motor at the reference position with certainty. Subsequently, when the $O_2$ sensor 9 remains deactivated, an atmospheric pressure-compensated preset value $PS_{CR}(P_A)$ is outputted from the arithmetic circuit 67 to the one input terminal of the comparator 70 which in turn supplies an output signal $S_{10}$ corresponding to the difference between the preset value $PS_{CR}(P_A)$ and a counted value supplied from the reversible counter 73, to the pulse motor driving signal generator 71, to thereby achieve accurate control of the position of the pulse motor 5. Also, when the other open loop control conditions are detected by the engine operating condition detecting circuit 65, similar operations to that just mentioned above are carried out.

Referring to FIG. 3, there is shown a circuit diagram illustrating the arrangement of a fail safe device for the air/fuel ratio feedback control system, which is provided within ECU 6. This fail safe device is incorporated in part of the pulse motor driving system which is operative in open loop mode.

A power switch SW, which may be formed by the ignition switch of the engine, is connected to the reed switch 7 forming part of the reference position detecting device for the pulse motor 5, by way of a constant-voltage regulated power supply 92 and a resistance $R_1$. The on and off action of the reed switch 7 causes the potential at the junction P of the reed switch 7 with the resistance R, to change in level between a high level H and a low level L. AND circuits 74, 75 are connected at their input terminals to the above junction P by way of an inverter 76 and directly, respectively. These AND circuits, 74, 75 are connected to at their output terminals to input terminals 77*a*, 77*b* of a pulse motor driving device 77, respectively. The AND circuits 74, 75 have their respective other input terminals connected to one output terminal 78*b* of a flip flop circuit 78 which in turn has a reset pulse input terminal R connected by way of another AND circuit 79 to the junction of a resistance $R_2$ with a capacitor C, the resistance $R_2$ and the capacitor C forming a CR circuit connected in series between the constant-voltage regulated power supply 92 and the ground. The flip flop circuit 78 has another output terminal 78*a* connected to input terminals of AND circuits 80, 81 which in turn have their output terminals connected to the input terminals 77*a*, 77*b* of the pulse motor driving device 77, respectively. Connected by way of an inverter 82 to one input terminal of the AND circuit 79 other than the input terminal connected to the junction of the resistance $R_2$ with the capacitor C is the output of an OR circuit 83. Connected to different input terminals of the OR circuit 83 are the respective output terminals of an $O_2$ sensor abnormality detecting device 84, an $O_2$ sensor-activation abnormality detecting device 85, an atmospheric pressure sensor abnormality detecting device 86, a pressure sensor abnormality detecting device 87, an engine temperature sensor (thermistor) abnormality detecting device 88 and an engine rpm sensor abnormality detecting device 89, these devices being provided for detecting various failures in the air/fuel ratio control system. The $O_2$ sensor abnormality detecting device 84 is adapted to generate a binary output of 1 when the output of the $O_2$ sensor 9 remains unchanged in level over a predetermined period of time (e.g., 1 minute) during closed loop control operation. The $O_2$ sensor-activation abnormality detecting device 85 is adapted to generate a binary output of 1 when the output of the $O_2$ sensor 9 is kept at a lower level than the reference voltage Vref over a predetermined period of time (e.g., 10 minutes) on condition that none of the other open loop control conditions is fulfilled and the engine coolant temperature Tw is higher than a predetermined value, e.g., 35° C. The other abnormality detecting devices 86–88 are adapted to generate respective binary outputs of 1 when respective ones of the atmospheric pressure sensor 10, the pressure sensor 12 and the thermistor 14, all being shown in FIG. 1, generate outputs which do not stay within their respective predetermined ranges over a predetermined period of time (e.g., 2 seconds). The engine rpm sensor abnormality detecting device 89 is adapted to generate a binary output of 1 when the condition is continuously fulfilled over a predetermined period of time, e.g., 2 seconds that the engine rpm is lower than 400 rpm and the absolute pressure in the intake pipe is lower than 560 mmHg.

Connected between the output of the OR circuit 83 and the input of the inverter 82 is an alarm device 90 which is adapted to perform an alarming section in a suitable manner when supplied with a binary output of 1 from the OR circuit 83.

On the other hand, the reference position signal processing circuit 68 in FIG. 2 has its input connected to the aforementioned junction P so that it outputs signals when the pulse motor 5 phases its reference position (50th step). The circuit 68 has its one output terminal connected to the set pulse input terminal S of the flip flop circuit 78 by way of an OR circuit 91, through which output terminal the circuit 68 is adapted to generate the pulse signal $S_7$ for permitting the pulse motor 5 to be driven in the step-increasing direction or in the step-decreasing direction in response to the output signal of the reference position detecting device 7. The reference position signal processing circuit 68 is adapted to generate the pulse signal $S_8$ each time the reference position detecting device 7 detects the pulse motor reference position, through its other output terminal which is connected to the input of the reference position register 72 in FIG. 2 which stores data indicative of the reference position (50th step) of the pulse motor 5. The register 72 has its one output terminal connected to one input terminal of the reversible counter 73 in FIG. 2. This reversible counter 73 has two input terminals **73*a*, 73*b* arranged to be supplied, respectively, with the output signal of the pulse motor driving device 77 and the output signal of a reversing time counter 93 which is arranged to count the number of times of reversal of the driving direction of the pulse motor 5, to thereby count the actual position of the pulse motor 5. The reversible counter 73 has its output connected to one input terminal 70*d* of the comparator 70 in FIG. 2**.

On the other hand, the pulse motor driving device 77 has its output connected to the pulse motor 5 and the input of another reversible counter 94 which in turn has its output connected to the input of the reversing time counter 93 and the reversal command input terminal **77*c* of the driving device 77. The reversing time counter 93 has its output connected to the inputs of an alarm device 95 and a register 96. The output of the reversing time counter 93 is also connected to another input terminal of the aformentioned OR circuit 91 and the input terminal 73*b* of the reversible counter 73**.

The reference position register 72 has another output terminal connected to one input terminal of an AND circuit 97 which has another input terminal arranged to be supplied with the output signal of the reversing time counter 93 by way of an inverter 98. The AND circuit 97 has its output connected to the output of another AND circuit 99, the junction of the above two outputs being connected to the other input terminal **70*e* of the comparator 70. The comparator 70 has three output terminals 70*a*, 70*b*, 70*c*. Assuming that the number of pulses supplied to the input terminal 70*d* from the reversible counter 73 is A, and the number of pulses supplied to the other input terminal 70*e* from the AND circuits 97, 99 is B, the output terminal 70*a* is adapted to generate an output signal when the relationship of $A<B$ stands, the output terminal 70*b* when the relationship of $A=B$ stands, and the output terminal 70*c* when the relationship of $A>B$ stands, respectively. While the output terminals 70*a*, 70*c* are connected to the respective other input terminals of the AND circuits 80, 81, the output terminal 70*b* is connected to one input terminal of another AND circuit 100. The AND circuit 100 has another input terminal connected to the output of the inverter 98 and its output to the input of the preset value register 66 in FIG. 2, respectively. Connected to the output of the register 66 is the arithmetic circuit 67 in FIG. 2 which in turn has its output connected to the input terminal 70*e* of the comparator 70 by way of an AND circuit 101. The AND circuit 101 has an input terminal other than that connected to the arithmetic circuit 67, connected to the output of the inverter 82** of the aforementioned abnormality detecting system.

The operation of the FIG. 3 arrangement will now be described. When the air/fuel ratio feedback control system is in a normally operative state, the outputs of the abnormmality detecting devices 84–89 are all at a low level of 0. Accordingly, the OR circuit 83 produces an output of 0 and the inverter 82 an output of 1, respectively, so that the AND circuit 79 can generate an output depending upon the potential at the junction of the resistance $R_2$ with the capacitor C. On this occasion, when the power switch SW is set on, the flip flop circuit 78 is reset due to an instantaneous delay in the rise time of the potential at the junction of the resistance $R_2$ with the capacitor C, to generate a high level signal of 1 through its output terminal **78*b*, which is applied to the respective one input terminals of the AND circuits 74, 75 (The flip flop circuit 78 is adapted to be reset by a low level signal applied to its reset pulse input terminal R, to generate a high level signal of 1 at its output terminal 78*b*). If at this instant the pulse motor 5 is positioned at the LEAN side where the actual air/fuel ratio is large so that the reed switch 7 is off, the potential at the junction P is at a high level of 1. Accordingly, the AND circuit 74 generates a low output of 0 and the AND circuit 75 a high output of 1, respectively. The high output of 1 of the AND circuit 75 is applied to the input terminal 77*b* of the pulse motor driving device 77 to cause the same to drive the pulse motor in the RICH or air/fuel ratio decreasing direction (The driving device 77 is adapted to drive the pulse motor 5 in the LEAN direction when its input terminal 77*a* is supplied with a high level signal, and in the RICH direction when its input terminal 77*b* is supplied with a high level signal, respectively). On the contrary, if the reed switch 7 is on, that is, the pulse motor 5 is on the RICH side when the power switch SW is set on, the AND circuits 74, 75 generate outputs of 1 and 0, respectively so that the driving device 77 drives the pulse motor 5** in the LEAN direction.

When the pulse motor 5 crosses the reference position during the course of being driven toward the RICH side, the reed switch 7 turns from its off position to its on position. Consequently, the AND circuits 74, 75 have their outputs inverted into a high level of 1 and a low level of 0, respectively, as in the case where the pulse motor 5 is on the RICH side upon setting on the power switch SW, so that the pulse motor 5 is reversed in direction to be then driven toward the LEAN side.

When the pulse motor 5 passes the reference position during the course of being driven toward the LEAN side, the reed switch 7 turns from its on position to its off position to cause a change in the potential at the junction P from a low level to a high level. The reference position signal processing circuit 68 is responsive to this change to generate the aforementioned signals. Responsive to the pulse signal $S_7$ outputted from the circuit 68, the OR circuit 91 applies as output of 1 to the flip flop circuit 78 to change the level at the output terminal 78*b* of the flip flop circuit 78 into 0 and simultaneously that at the output terminal 78*a* into 1, respectively, rendering the AND circuits 80, 81 operative. At the same time, the outputs of the AND circuits 74, 75 both become 0 to cause interruption of the pulse motor driving device 77 to stop the pulse motor 5. The pulse signal $S_8$ which is outputted from the reference position signal processing circuit 68 is applied to the register 72 which in turn is triggered by this signal $S_8$ to have its stored reference position value (50 steps) read into the reversible counter 73. The reversible counter 73 applies the same value to one input terminal 70*d* of the comparator 70. At the same time, the register 72 applies the same reference position value (50 steps) to one input terminal of the AND circuit 97. At this instant, the other input terminal of the AND circuit 97, which is connected to the output of the reversing time counter 93 by way of the inverter 98 as previously noted, is supplied with an output of 1 from the counter 93 if the number of times of reversal of the pulse motor 5 does not yet reach a predetermined value (e.g., three times). Therefore, the comparator 70 has its input terminal 70*e* supplied with the same reference position value (50 steps), too. As a consequence, the comparator 70 applies an output of 1 to one input terminal of the AND circuit 100 through its output terminal 70*b*. Since as noted above the AND circuit 100 then has its other input terminal supplied with an output of 1 from the inverter 98, it outputs an output of 1 and applies the same to the register 66 which is triggered by this output to have its stored value indicative of the initial setting position $PS_{CR}$ (e.g., 40 steps) for the pulse motor 5, read into the arithmetic circuit 67. In the circuit 67, the input value is compensated for atmospheric pressure and then applied to the input terminal 70*e* of the comparator 70 through the AND circuit 101 which at this instant, is in an open state, since its input terminal other than that connected to the circuit 67 is then supplied with an output of 1 from the inverter 82. Then, in the comparator 70 the input relationship of $A > B$ stands. Thus, the comparator 70 outputs pulses at its output terminal 70*c* and applies the same to the RICH side driving terminal 77*b* of the pulse motor driving device 77 by way of the AND circuit 81, to cause the same device 77 to drive the pulse motor 5 by steps corresponding to the difference between the pulses A and those B, thus setting the pulse motor 5 to its initial predetermined position $PS_{CR}(PA)$.

After the above initial position setting operation for the pulse motor 5 is over, the air/fuel ratio feedback control system carries out closed loop control or open loop control, depending upon the operating condition of the engine. As previously described, during the closed loop control, the pulse motor driving device 77 is controlled by the control signal $S_5$ supplied from the PI control circuit 63 in FIG. 2, while during the open loop control, the driving device 77 is controlled in the same manner as in the pulse motor initial setting operation described above, that is, it is driven by steps corresponding to the difference between an atmospheric pressure-compensated preset value corresponding to an associated open loop condition fulfilled and the value of the signal indicative of the actual pulse motor position, outputted from the reversible counter 73, that is, the difference between the pulses A and those B which is supplied from the comparator 70.

When there occurs a failure in the air/fuel ratio feedback control system, one of the aforementioned abnormality detecting devices 84–89 which corresponds to the cause of the failure generates an output of 1 as a fault signal and applies the same to the OR circuit 83 which in turn generates an output of 1. This output of 1 is supplied to the alarm device 9 to cause the same to perform an alarming action. The same output of 1 is also supplied to the inverter 82 which in turn outputs an inverted output of 0 so that the output of the AND circuit 79 goes low to cause the flip flop circuit 78 to be resetted, followed by a similar operation to that carried out upon setting on the power switch, previously described. More specifically, the pulse motor driving device 77 is then operative to drive the pulse motor 5 in such a direction as it crosses the reference position. When the pulse motor 5 crosses the reference position, the reference position processing circuit 68 generates the reference position signal $S_7$, followed by a similar operation to the aforedescribed pulse motor initial position setting operation which involves interruption of the operation of the pulse motor driving device 77. On this occasion, the other reference position signal $S_8$ outputted from the processing circuit 68 leads to equalization of the inputs A, B applied to the comparator 70, which causes the AND circuit 100 to apply an output of 1 to the preset value register 66. However, at this instant one input terminal of the AND circuit 101 connected to the output of the arithmetic circuit 67 is supplied with an output of 0 from the inverter 82, which prohibits transfer of output data from the arithmetic circuit 67 to the comparator 70. Consequently, the outputs at the output terminals of the comparator 70 are both 0 so that the pulse motor driving device 77 is not driven in either of the RICH and LEAN directions, to cause stoppage of the pulse motor 5 exactly at the reference position without fail.

The failures which possibly occur in the air/fuel ratio feedback control system can include that in the reference position detecting device (reed switch) 7. That is, there is the possibility that even when the pulse motor 5 passes its reference position (50th step), the reed switch 7 outputs no signal indicative of this passage due to its failure during the pulse motor initial position setting operation or the subsequent air/fuel ratio control operation. In such event, the reference position signal processing circuit 68 does not generate either of the reference position signals $S_7$, $S_8$. As a consequence, in the manner previously mentioned the pulse motor driving device 77 continues to drive the pulse motor 5 in the LEAN direction or in the RICH direction depending upon the value of the output signal of the reed switch 7 then outputted, until the pulse motor 5 is driven to its extreme operating position (120th step or zeroth step). While the pulse motor 5 is thus driven, the reversible counter 94 counts the number of pulses outputted from the driving device 77. Upon counting up the number of steps corresponding to the whole stroke of the pulse motor 5, the reversible counter 94 applies a reversal command to the reversal command input terminal 77*c* of the driving device 77. Responsive to this reversal command, the driving device 77 drives the pulse motor 5 in the direction reverse to that in which it has so far been driven. In this manner, until the reference position of the pulse motor 5 is detected, the above driving of the pulse motor 5 through the whole pulse motor stroke and its reversal are repeated. The reversible counter 94 outputs a single pulse signal and applies the same to the reversing time counter when the pulse motor 5 is driven to the extreme operating position on the RICH side (zeroth step). The reversing time counter 93 counts the number of this signal and upon counting up to a predetermined number, that is, when the number of times of reversal of the pulse motor 5 exceeds a predetermined number (e.g., three), it applies a reversing time signal in the form of continuous direct current voltage to the alarm device 95 for alarming of the failure in the reed switch 5, as well as the register 96. The register 96 stores data indicative of steps corresponding to a predetermined pulse motor position, e.g., the predetermined idle position $PS_{IDL}(P_A)$ compensated for atmospheric pressure at which a moderate air/fuel ratio can be obtained, as a position for the pulse motor to be set to in the event of such reed switch failure. When supplied with the above reversing time signal, the register 96 has its stored data applied to the input terminal 70*e* of the comparator 70 via the AND circuit 99. The AND circuit 99 has its one input terminal supplied with the above reversing time signal and its other input terminal with a signal from the register 96, which corresponds in bit to the contents stored in the register 96, respectively. At the same time, the same reversing time signal outputted from the reversing time counter 93 is also supplied to the reset pulse input terminal 73*b* of the reversible counter 73 and the OR circuit 91, the counter 93 being reset to zero by the same signal and the OR circuit 91 causing the flip flop circuit 78 to be set to generate a high output of 1 at its output terminal 78*a*.

Therefore, in the comparator 70, the input value A at the input terminal 70*d* is zero and that B at the input terminal 70*e* corresponds to the predetermined pulse motor idle position B. Since the relationship of $A<B$ thus stands, a signal corresponding in value to the difference between A and B is outputted from the output terminal 70*a* to one input terminal of the AND circuit 80. Since at this instant the other input terminal of the AND circuit 80 is supplied with an output of 1 from the output terminal 78*a* of the flip flop circuit 78 as previously mentioned, the pulse motor driving device 77 has its input terminal 77*a* supplied with an output signal from the AND circuit 80 to drive the pulse motor 5 in the LEAN direction from its extreme operating position on the RICH side, thus setting the pulse motor to its predetermined idle position. Incidentally, on this occasion, the AND circuits 74, 75 have their respective one input terminals supplied with an output of 0 from the output terminal 78*b* of the flip flop circuit 78 to apply outputs of 0 to the input of the driving device 77, permitting the above setting of the pulse motor to the predetermined idle position to be positively carried out.

Although in the FIG. 3 embodiment, the reversible counter 94 has its maximum count in accord with the number of steps of the pulse motor 5 between its opposite extreme operating positions, it may be so arranged that the counter 94 has its maximum count equal to the number of steps (e.g., 80 steps) which is the larger of the two numbers of steps each being the number of steps between each of the extreme operating positions and a position slightly beyond the switching point of the reed switch 7 driven from the above extreme operating position. By this arrangement, early detection of a trouble as well as remedy therefore is possible. Even with such arrangement, the reversible counter 94 is adapted to supply a command signal to the reversing command input terminal 77*c* of the pulse motor driving device 77 upon counting down or up a predetermined value (0 or 80). Further, the counter 94 applies a single pulse signal to the reversing time counter 93 each time the counted value reaches one of the predetermined values (0). When the number of times of reversal of the driving direction of the pulse motor exceeds a predetermined value, the pulse motor 5 is driven in the same direction as that in which it has so far been driven, by steps (e.g., 40 steps) obtained by subtracting the maximum number of steps that can be counted by the counter 94 from the number of steps required for the pulse motor 5 to be driven through its whole stroke. At the same time, the reversing time counter 93 supplies a reversing time signal to the alarm device 95, the register 96, the reset pulse input terminal 73*a* of the reversible counter 73 and the OR circuit 91, like the FIG. 3 embodiment previously described.

Further, in the above-mentioned arrangements, when the reference position for the pulse motor cannot be detected, it may be arranged such that the pulse motor 13 is driven through steps (e.g., 135 steps) slightly larger than the number of steps (120) for the whole stroke so as to ensure movement of the pulse motor to its extreme operating position. In this case, the reversible counter 94 is adapted to count no more than the number of steps larger than that for the whole stroke (the count is held at 0 or 120).

What is claimed is:

1. In an air/fuel ratio feedback control system for performing feedback control of the air/fuel ratio of an air/fuel mixture being supplied to an internal combustion engine, said system comprising: a sensor for detecting the concentration of an exhaust gas ingredient emitted from said engine; an air/fuel ratio control valve having a valve body position thereof disposed to determine the air/fuel ratio of said air/fuel mixture being supplied to said engine; an actuator arranged to displace said air/fuel ratio control valve in a continuous manner in response to an output signal generated by said sensor; and reference position detecting means for generating a first signal when said actuator passes a predetermined reference position provided between two opposite extreme operating positions which mechanically limit a movable range of said actuator, a fail safe device comprising first means for detecting a failure in said air/fuel ratio feedback control system and generating a second signal when said failure is detected; and second means responsive to said second signal to drive said actuator, said second means being adapted to stop said actuator at said predetermined reference position immediately upon being supplied with said first signal while it is driving said actuator, said second means including means for repeatedly driving said actuator over a predetermined operating range inclusive of said predetermined reference position in one direction and in a direction reverse thereto alternately a plurality of times when it is not supplied with said first signal upon said actuator passing said predetermined reference position, and means for driving said actuator from a second predetermined reference position which is one of said extreme operating positions, to a predetermined position and holding te same there when it is not supplied with said first signal even after a predetermined number of times of said repeated driving of said actuator.

2. In an air/fuel ratio feedback control system for performing feedback control of the air/fuel ratio of an air/fuel mixture being supplied to an internal combustion engine, said system comprising: a sensor for detecting the concentration of an exhaust gas ingredient emitted from said engine; and air/fuel ratio control valve having a valve body position thereof disposed to determine the air/fuel ratio of said air/fuel mixture being supplied to said engine; an actuator arranged to displace said air/fuel ratio control valve in a continuous manner in response to an output signal generated by said sensor; and reference position detecting means for generating a first signal when said actuator passes a predetermined reference position provided within a central zone between two opposite extreme operating positions which mechanically limit a movable range of said actuator, a fail safe device comprising first means for detecting a failure in said air/fuel ratio feedback control system and generating a second signal when said failure is detected; and second means responsive to said second signal to drive said actuator in a direction such that said actuator crosses said predetermined reference position, said second means being adapted to stop said actuator at said predetermined reference position substantially immediately upon being supplied with said first signal while it is driving said actuator.

3. The fail safe device as claimed in claim 1, wherein said second means is responsive to drive said actuator in a direction such that said actuator crosses said first-mentioned predetermined reference position.

* * * * *

UNITED STATES PATENT AND TRADEMARK OFFICE

CERTIFICATE OF CORRECTION

PATENT NO. : 4,414,950

DATED : November 15, 1983

INVENTOR(S) : Kazuo Otsuka, Shin Narasaka & Shumpei Hasegawa

It is certified that error appears in the above-identified patent and that said Letters Patent is hereby corrected as shown below:

Column 1, line 68, change "this" to --thus--.
Column 2, line 37, "the" to --an--.
Column 3, line 24, change"heating" to --having--.
Column 11, line 20, change "section" to --action--.
Column 11, line 26 change "phases" to --passes--.
Column 14, line 20 change "9" to --90--.

Signed and Sealed this

*Fifth* Day of *November 1985*

[SEAL]

*Attest:*

*Attesting Officer*

DONALD J. QUIGG

*Commissioner of Patents and Trademarks*